United States Patent [19]

Hunter et al.

[11] Patent Number: 4,518,953

[45] Date of Patent: May 21, 1985

[54] SECURITY FENCE SYSTEM

[76] Inventors: Kent Hunter, Frost Mill Rd., Mill Neck, N.Y. 11765; Lawrence D. Hunter, 2509 Calle Montilla, Santa Barbara, Calif. 93109

[21] Appl. No.: 499,712

[22] Filed: May 31, 1983

Related U.S. Application Data

[63] Continuation of Ser. No. 198,889, Oct. 20, 1980, abandoned.

[51] Int. Cl.[3] ..... G08B 13/22

[52] U.S. Cl. ..... 340/564; 340/533; 340/650; 340/652; 256/10

[58] Field of Search ..... 340/662, 661, 652, 651, 340/650, 644, 566, 564, 550, 549, 548, 547, 546, 545, 533; 324/66, 52, 51; 256/10, 1

[56] References Cited

U.S. PATENT DOCUMENTS

| | | | |
|---|---|---|---|
| 587,931 | 8/1897 | Coleman | 340/550 |
| 1,483,005 | 2/1924 | McNair | 340/550 X |
| 2,215,718 | 9/1940 | Schaefer | 256/10 |
| 2,364,994 | 12/1944 | Moore | 340/524 X |
| 2,398,442 | 4/1946 | Moore | 256/10 |
| 2,421,771 | 5/1949 | Browning | 340/564 |
| 2,512,740 | 6/1950 | Evans | 256/10 |
| 2,530,247 | 11/1950 | Koonz | 256/10 |
| 3,047,849 | 7/1962 | Hansen | 340/564 |
| 3,230,518 | 1/1966 | Vassil et al. | 340/564 X |
| 3,375,511 | 3/1968 | Trimble et al. | 256/10 X |
| 3,999,175 | 12/1976 | Thibodeau | 340/644 |
| 4,155,083 | 5/1979 | Slaats et al. | 340/666 |
| 4,196,890 | 4/1980 | Einhorn | 256/10 X |
| 4,208,627 | 6/1980 | Ebert, Jr. | 340/650 X |
| 4,291,356 | 9/1981 | Mathieu | 340/661 X |

FOREIGN PATENT DOCUMENTS

| | | | |
|---|---|---|---|
| 20928 | 8/1905 | Austria | 340/564 |
| 344983 | 11/1904 | France . | |
| 2445105 | 8/1980 | France | 256/10 |

OTHER PUBLICATIONS

IBM Technical Disclosure Bulletin; "Voltage Comparator Circuit", by C. D. Driscoll, vol. 17, No. 4, Sep. 1974; pp. 1151, 1152.

*Primary Examiner*—James L. Rowland
*Assistant Examiner*—Daniel Myer
*Attorney, Agent, or Firm*—Nolte, Nolte and Hunter

[57] ABSTRACT

A security fence system employs a plurality of very thin, high tensile strength, highly stressed wires arranged relatively close together and between each of which is connected an electrical resistance. A voltage source causes a current to flow through the series-connected wires and resistors. An annealed segment can be formed in each high tensile strength wire and located between the points where each wire is attached to the fence posts, to make stretching of the wires without breaking them impossible. A sensing circuit is connected to the fence and includes voltage comparators and potentiometers for providing adjustable triggering levels. The comparators detect when the current flowing in the fence is altered and trigger an alarm if any of the wires are broken, or if any of the wires contact one another. The alarm can be turned off only by normalizing the fence and actuating a reset switch.

19 Claims, 11 Drawing Figures

SECURITY FENCE SYSTEM

This application is a continuation of application Ser. No. 198,889, filed Oct. 20, 1980, now abandoned.

BACKGROUND OF THE INVENTION

The present invention relates generally to fences and, more specifically, to a fence employing a number of wires to which is attached an electrical sensing device.

There have been countless systems proposed for use in keeping unwanted persons or animals out of selected areas. Two approaches are popular in providing a fenced-in secure area, one such approach being a fence which actually physically excludes entrance from the area, e.g., a chain link fence, barbed wire fence, or the like. Another popular approach is to provide an electrified fence, wherein the fence is connected to a relatively high voltage which provides an electrical shock to a person or animal attempting to gain entry.

More recently, with the advent of more sophisticated electronic technology, security fences have employed proximity sensing systems and motion sensors. One approach is to utilize a magnetic field, produced by electrified fence wires, which is altered by the presence of a body. The altered magnetic field may be detected and used to indicate a possible intrusion. A similar approach is to use a capacitive field around the fenced area, alterations of which may also be sensed. The most popular approach is to use motion sensors attached to a chain link fence.

All of these present fences suffer from one or more drawbacks and, as may be expected, for every new kind of fence proposed, unscrupulous persons will devise methods for beating the security and entering the restricted area.

One of the principal drawbacks in most electrified systems which sense the presence of intruders is their high cost, both in initial cost and in installation costs. Additionally, they are generally very susceptible to false alarms and thus often require a full-time watchman in order to monitor the security system.

Therfore, there exists an almost ongoing need for improved security fencing systems, as well as a need to provide such systems at a resonably affordable cost.

SUMMARY OF THE INVENTION

The present invention provides a security fence system having a plurality of very thin wires arranged in proximity and under relatively high tension which may have annealed sections therein which will break if the wires are stressed further by being spread excessively. Additionally, an electronic sensor apparatus is connnected to the wire fencing which will sense either a break in a single wire or electrical contact with another wire. The inventive electronic system permits the fence to be zoned so that the location of any attempted break-in may be quickly determined.

In one embodiment the wires provided in the inventive fence are extremely thin, having a diameter of approximately 0.03 inches (22 guage) and are arranged between posts which may be anywhere from 5 to 100 feet apart depending upon the kind of security needed. Other embodiments are contemplated wherein the wire diameters can range from 28 guage on down to wire diameters which are so large that they are difficult to handle efficiently. The thin wires may be spaced apart from each other anywhere from 2 to 4 inches and a high tensile stress of approximately 65 pounds is applied to each wire. In order to withstand such high tensile loads the wires must be extremely strong. Thus, the inventive fence wire system itself provides a very high degree of security when posts are close. The present invention teaches that at selected intervals along the length of each of the thin wires a small annealed segment may be provided which lowers the tensile strength of the wire and, upon excessive stretching, will cause the wire to snap at the annealed point. The breaking of the wire in this manner is immediately detected by the inventive sensing apparatus.

The individual horizontal fence wires are electrically connected together with resistors to form a series resistance network. Therefore, physical or electrical contact between wires pesents a relatively large resistance change, which is sensed by the inventive sensing apparatus. The inventive sensing apparatus operates such that even a momentary break in one of the wires, or contact between them, will trigger the alarm. By means of the inventive sensing apparatus, once an alarm has been given it cannot be extinguished by the electrical reconnection of the wire or the breaking of the contact; the alarm must be reset at the monitoring station after normalization of the fence.

In the embodiment employing thin wires, the thinness of the wires has several advantages. First, thinner wires are less expensive. Wire cost is a major consideration because preferably the wires are made of stainless-steel so as to maintain good electrical contact capability. Second, with thin wires it is economically feasible to put them under tension so that they will not sag more than a few thousandths of an inch, even over distances of 40 feet. This feature is important and contributes to the false-alarm-free characteristics of this security fence and, when annealed segments are used, permits the wires to break upon less vertical displacement. Third, in winter the wires contract and their tension increases. With thin wires the increase in tension is not great and the attendant anchoring of end posts and corner posts, the posts that bear the tension load, need not be of a massive scale. This advantage also pertains throughout the year, since use of the thin wires generally permits economic end post construction. Fourth, the fence is esthetically unique in that from approximately 30 feet away the wires can not be seen in most environments.

Therefore, it is an object of the present invention to provide a security system which employs a high integrity wire fence having an electronic sensor connected thereto.

It is another object of the present invention to provicde a fence system having a plurality of high strength, very small diameter wires, arranged in proximity, one to another, wherein a high tensile force is applied to each wire.

It is a further object of the present invention to provide a fence system employing a number of high strength small diameter wires arranged with a high tensile force, wherein a segment in each of the wires has been annealed so as to lessen the tensile strength of the wire at that point.

It is still a further object of the present invention to provide a security fence system which employs a number of wires with an electrical resistor between each pair of wires in such a manner that the wires and resistors are in series and being connected to a voltage comparator sensing system which can detect small changes in the current flowing through the fence wires and resistors.

The manner in which these and other objects are accomplished by the present invention will become clear from the following detailed description.

Figure 10:
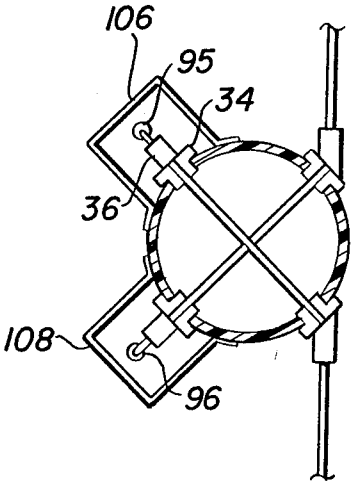
Figure 9:
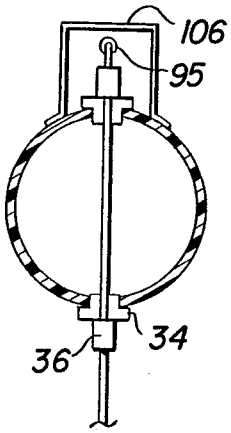
Figure 8:
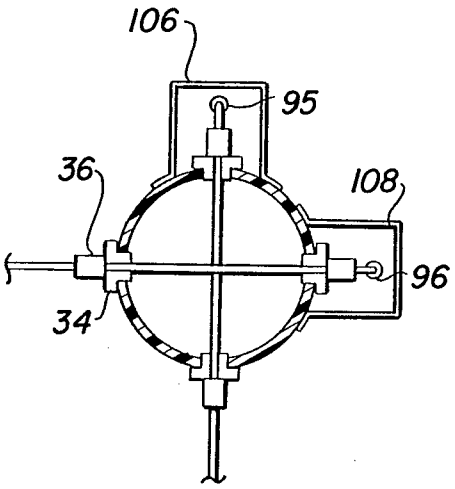
Figure 11:
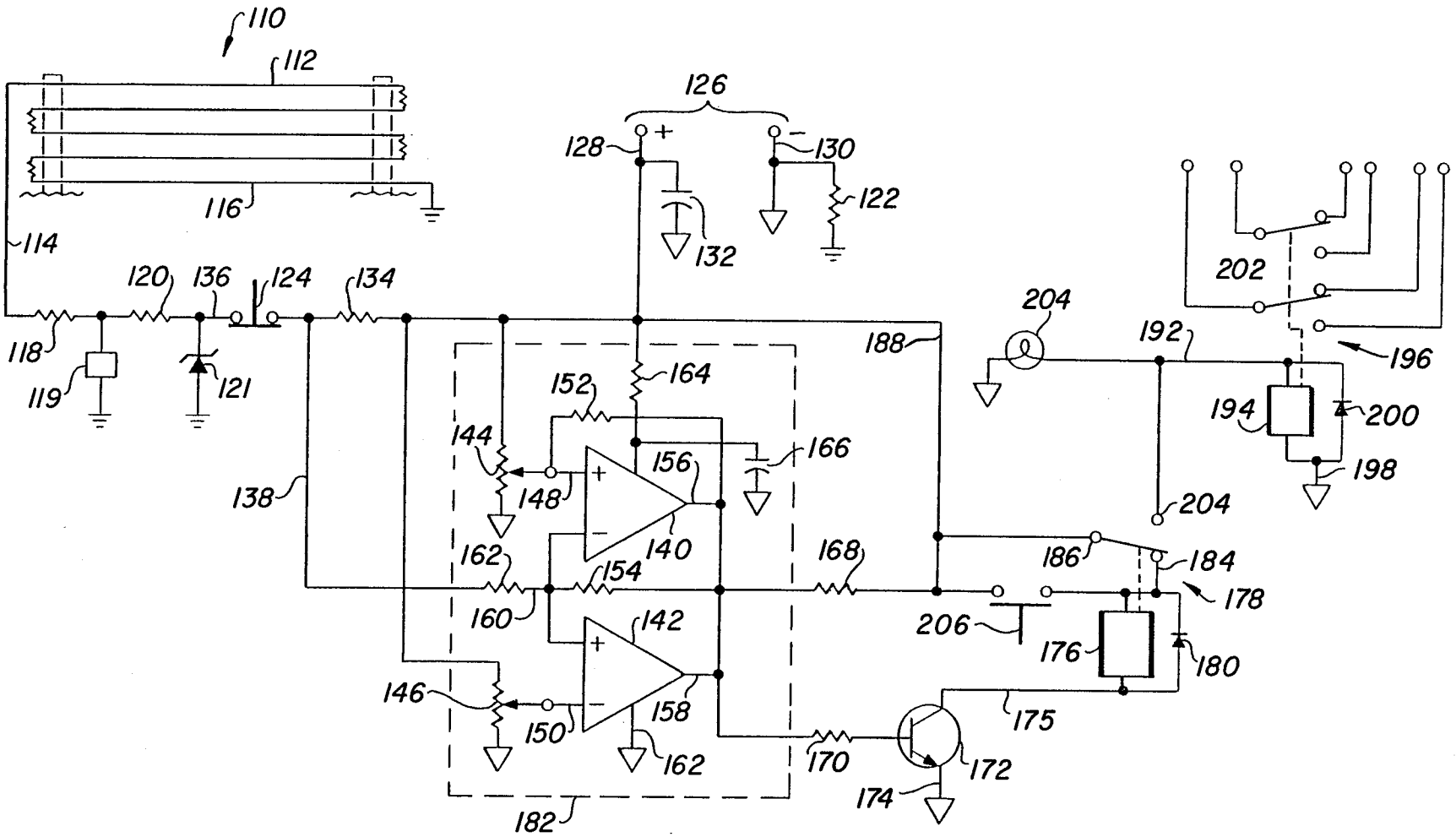

FIG, 7 is a schematic of the fence wire and resistor network;

FIG. 8 is a top plan view in cross section of a corner post of the inventive fence at which the fence wires terminate;

FIG. 9 is a top plan view in cross section of an end post of the inventive fence at which the fence wires terminate;

FIG. 10 is a top plan view in cross section of a line post of the inventive fence at which the fence wires terminate; and FIG. 11 is a circuit diagram in schematic form of the inventive sensing apparatus.

DETAILED DESCRIPTION OF THE INVENTION

Figure 1:
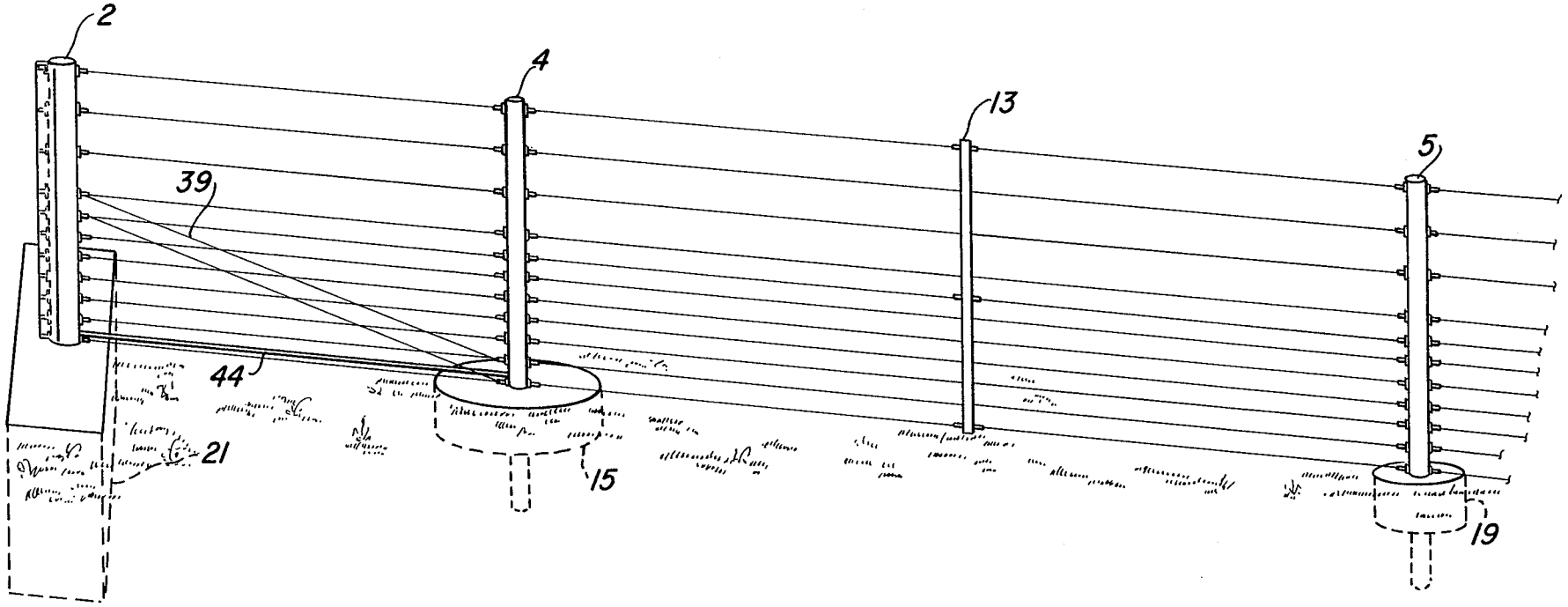
FIG. 1 is a perspective of a portion of the inventive fence.
Figure 2:
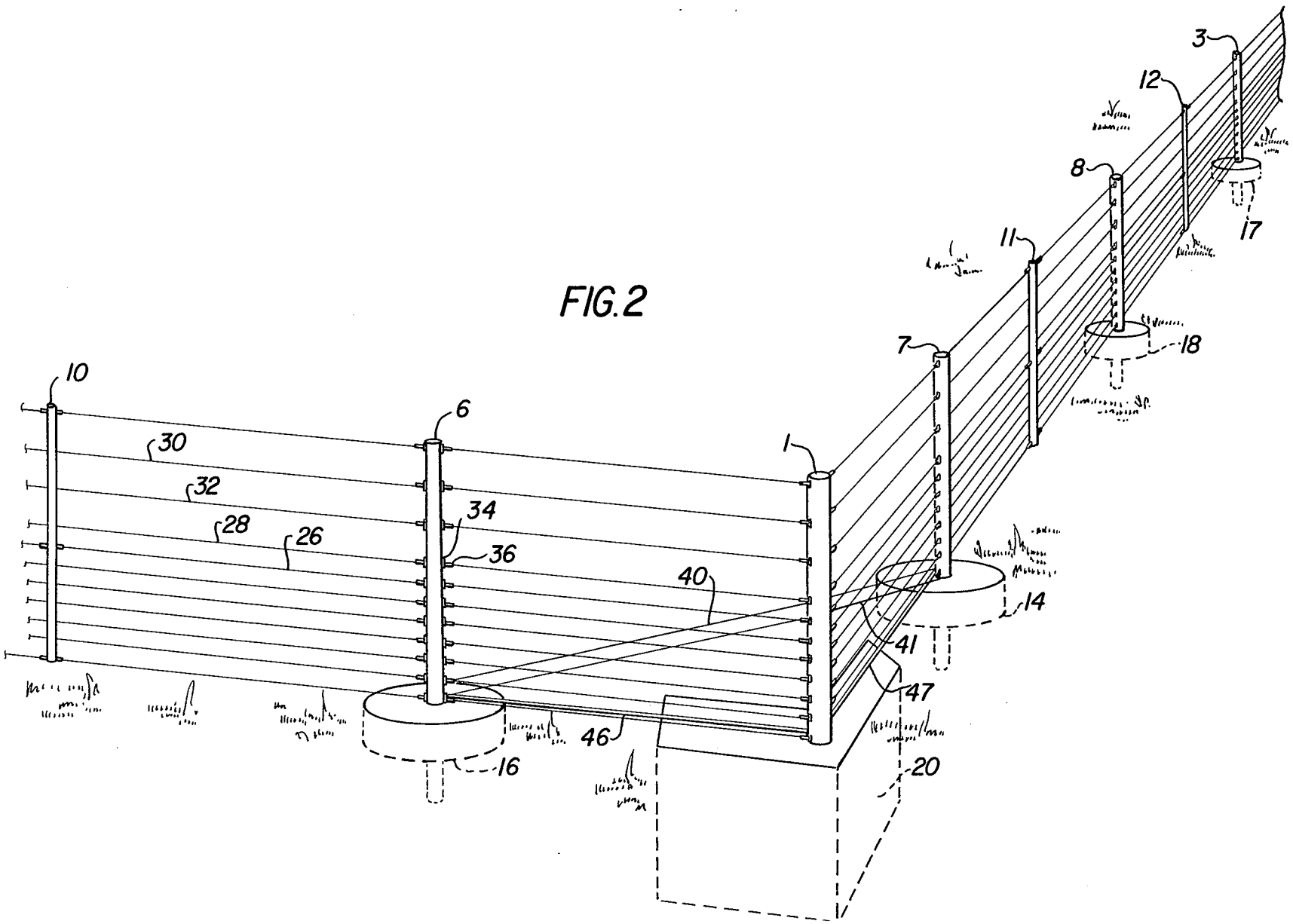
FIG. 2 is a perspective of a portion of the inventive fence showing a corner post.

Referring now to FIGS. 1 and 2, which show in perspective a portion of a security fence system according to the present invention, a corner post 1, an end post 2, six line posts 3, 4, 5, 6, 7, and 8 and four intermediate posts 10, 11, 12, and 13 are shown. The line posts are preferably steel pipes or tubes having a nominal outside diameter of 2½ inches. These posts are vertically arranged and set in the ground in concrete anchors or piers 14, 15, 16, 17, 18, and 19. The corner post 1, or the end post 2 if the fence does not continue, is preferably a four-inch nominal outside diameter, schedule 40 steel pipe. Such heavy pipe is required due to the high forces at the corners and ends of the fence. These posts are vertically arranged and set into the ground by rectangular concrete anchors or piers 20, 21. These concrete anchors 20, 21 should be arranged so as to have the longitudinal axis of a rectangular segment perpendicular to the line of the fence, as shown in FIGS. 1 and 2.

Located between the line posts are the intermediate posts 10, 11, 12, 13 formed of polyvinyl chloride (PVC), which serve to eliminate false alarms and increase the security of the fence without using additional more expensive line post assemblies. The weight of these intermediate posts 10, 11, 12, 13 does not perceptably affect the straightness of the fence wires, therefore, it is not an absolute requirement that these intermediate posts be supported by the ground. The intermediate posts are electrically protected and their operation will be explained below.

While the end posts, line posts, and corner posts have been disclosed as being steel pipe, they could also be formed of wood or any other suitable fence post material, including concrete. Similarly, while the intermediate posts 10, 11, 12, 13 are disclosed as being formed of PVC, they could be formed of any weather-proof, strong, electrically insulating material. Additionally, it is noted that the fence of FIG. 1 is not intended to be drawn to scale. For example, the distance between the posts could be anywhere from 5 to 100 feet depending upon the application of the fence.

The wires 26, 28 are preferably formed of high-strength stainless steel, which has been cold drawn to achieve very high tensile strength. The wire is nominally 0.3 inches in diameter. As a further distinction, the wires are arranged quite closely together when compared to conventional standard fences with only horizontal wires, such as barbed wire fences. For example, the distance between wires 26 and 28 is preferably two inches, with wires 30 and 32 of the upper half of the fence having four inch spacing. Once again, it is pointed out that FIG. 1 is not intended to be drawn to scale, thus, while only eleven wires are shown, it is understood that as many wires as are required could be utilized to form a fence of any height. Also, the spacing shown in not intended to limit the scope of the invention. This inventive fence is not height limited and the fence can be made as high as desired by adding any number of horizontal wires.

It is a requirement of this invention to insulate the individual fence wires from the fence posts. This is required not only when utilizing metal fence posts but also when using wooden fence posts, since ions from a number of sources made wet wood electrically conductive. Specifically, the fence wires are electrically insulated from the posts, 1 through 8, by means of small insulators, shown typically at 34. The insulators 34 may be formed of any strong, high dielectric insulating material, such as phenolic or a ceramic material such as alumina. These insulators 34 are shown in more detail in FIGS. 6, 8, 9 and 10.

The wires are firmly affixed at each post by means of tubular ferrules, shown typically at 36, which are swaged onto the wires at each entry and exit point on each line post, end post, or corner post to limit stretching of the wires by an intruder to the place of intrusion. The swaging of the ferrules 36 onto the fence wires forms a high-frictional contact with the fence wire, so as to firmly affix the ferrules to the wire.

Prior to installation of the inventive fence, the posts are first drilled with the proper number of holes and on the proper centers. In this regard, it has been found that drilling ⅜-inch holes on four-inch centers for the top half of the fence and two-inch centers for the bottom half provides an advantageous fence. The posts are then set in concrete at the specified height and the concrete permitted to set. If one-piece intermediate posts are utilized, these are set in place. The wires are then strung by feeding each wire through the hole in each post, while at the same time threading onto the wire the necessary insulators and ferrules. The wire is pulled to a high tension. Preferred tension is approximately 65 pounds when utilizing high-strength wire approximately 0.3 inches in diameter.

With some soil conditions, the corner post anchors and the end post anchors will have to be quite massive to resist horizontal movement in the ground caused by the fence wire tension of 65 pounds times the number of fence wires. Thus, in some cases it may be more economical and feasible to use several, less massive anchors for each of the first few line posts going away from the end or corner posts, and to separate all of the above posts by horizontal compression beams at ground level. When a fence is short, it may be most economical to use compression beams or pipes at ground level along the entire fence, in which case, however, the concrete anchors or piers must still be used to resist vertical force vectors. These vertical vectors are caused by diagonal compression beams or pipes 39, 40, and 41 in FIGS. 1 and 2, which along with compression beams or pipes 44, 46, 47 in FIGS. 1 and 2 keep the corner posts and end posts vertical. Specifically, the corner or end post anchors must resist the upward vector of the fence wire tension. Corner post anchors will have to have double the mass of end post anchors since they will have upward vectors from two sets of fence wires; and the anchors 14, 15, 16 in FIG. 1, where the diagonal compression posts 39, 40, 41 reach ground level, must resist the downward vector of the fence wire tension.

Another embodiment, not shown, of this fence system utilizes horizontal beams at the top and bottom between all of the metal posts of the fence and does not require any specialized concrete anchors except standard, chain-link fend type anchors, and also does not require any diagonal compression posts. The bottom horizontal compression posts are at ground level and replace the bottom two wires of a fence in which the wires of the bottom half are spaced two inches apart. The top horizontal compression posts are arranged between the top two wires of the fence if they are spaced four inches apart. Since the top wire is close to the top horizontal compression post, an intruder climbing over the fence with a ladder can not step on the top horizontal post without setting off the alarm unless its first insulated. Alternatively, the bottom horizontal beams could be replaced by a continuous concrete footer.

The above-described embodiment will be easier to go over with a pair of ladders than a fence with no top bar and will usually cost more. Nevertheless, this climbing disadvantage is small and for very short fences, such as around a modest home, or for very complex fences, such as fences with many gates or frequent changes in direction, this version may be the least expensive.

Because the fence wires are of high-strength steel, and because along the length of the wires they are firmly affixed to the fence posts, a very desirable option exists. In each fence wire and between each pair of posts, other than the intermediate posts, a very short wire segment is annealed, for example, at points P in FIG. 7. In this regard, annealing is used herein in its conventional meaning, i.e., to heat and then cool slowly for softening. This mechanical and metallurgical feature of the present invention is most important, because it then makes it possible for the high-strength wires to break or part when a person attempts to pass through the fence by stretching the wires. The preferable high-strength wire is generally know as cold-drawn, and this cold-drawing process provides most of the high strength by elongating and aligning the metallic crystals in the wire. By heating a short portion of the wire to just below the melting point and then cooling that portion slowly, the metal crystals are realigned into their normally weaker state, thereby providing a weakened link in the high tensile strength wire. Hence, that short segment of the wire is effectively annealed. It is desirable to make this weakened link in the wire as linearly short as possible so that it can not neck down. It has been found that by annealing a short section that the strength of the wire at this annealed point is approximately one third that of the unannealed tensile strength of the wire. In this manner the fence wire between any two regular posts can stretch only a very small amount and in no event can the remaining wire ever exceed its elastic limit or yield strength before this much weaker annealed section parts. By locating an annealed section between regular posts, when a person attempts to spread the wires to gain entrance or exit, the wires can be stretched only a very short distance before they will break. However, if posts, including intermediate posts, are placed close together, such as five feet apart, it is extremely difficult to break the wires; and the fence, therefore, can remain practically false-alarm-proof even when this annealed weak-link feature is included. Of course, once a wire breaks it will be immediately detected by the inventive sensor equipment, the operation of which will be described below.

In regard to the use of the plastic intermediate posts 10, 11, 12, 13, if the wires of the fence are long enough between posts to be spread apart sufficiently to permit a trespasser to pass through without breaking, they will generally touch each other and trigger the sensor. However, if the trespasser insulates the wires with tape, then it might be possible for the wires to be spread sufficiently to gain entry without breaking and also without making contact. If the posts are spaced close enough together, the annealed portions will break before the wires can be stretched far enough apart to allow a trespasser through. The use of closer spaced posts also decreases the possibility of false alarms by such causes as animals, children, and falling debris. These less expensive plastic posts with fewer ferrules can be used to provide some of the same functions as the metal posts with a full compliment of ferrules and insulators. Thus, the present invention teaches the use of a small number of plastic posts positioned between the metal posts. These intermediate posts need not have every wire firmly affixed to them, although each wire must pass through each post. It is necessary to firmly attach the horizontal wires to the intermediate post only at the top and bottom and one or two points spaced therebetween. This prevents the intermediate posts from being slid along the length of the wires. When the posts, including the intermediate posts, are placed close together, such as 5 feet apart, the unannealed, highly stressed, high tensile strength wires become a very formidable physical barrier that trespassers would almost certainly cut to penetrate, thereby setting off an alarm. Annealing will therefore not be required by all users.

Closely spaced posts will not always be required when the purpose of the security fence is to keep large objects within an enclosure but not to keep people out. Spacing will depend upon the size of the objects to be contained. If the objects are wheelbarrows, carts, or liverstock, 50 foot spacing may be adequate; if the objects are five-gallon drums, 20 foot spacing can prove adequate. All applications may not require intermediate posts.

Figure 5:
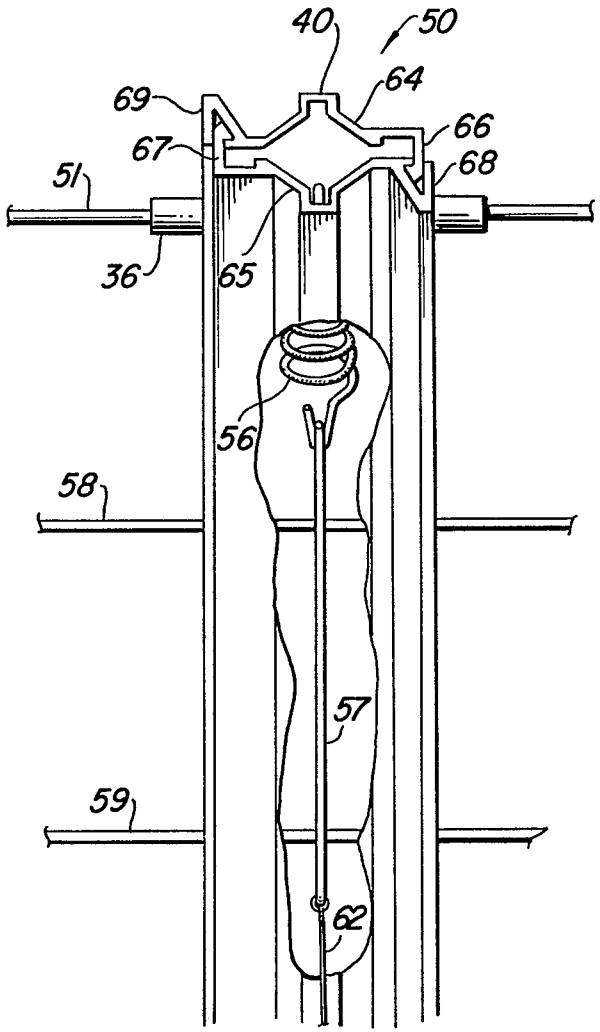
FIG. 5 is a perpective of an embodiment of an intermediate post of the inventive fence employing a specialized plastic extrusion and having a portion broken away to show the interior.
Figure 4:
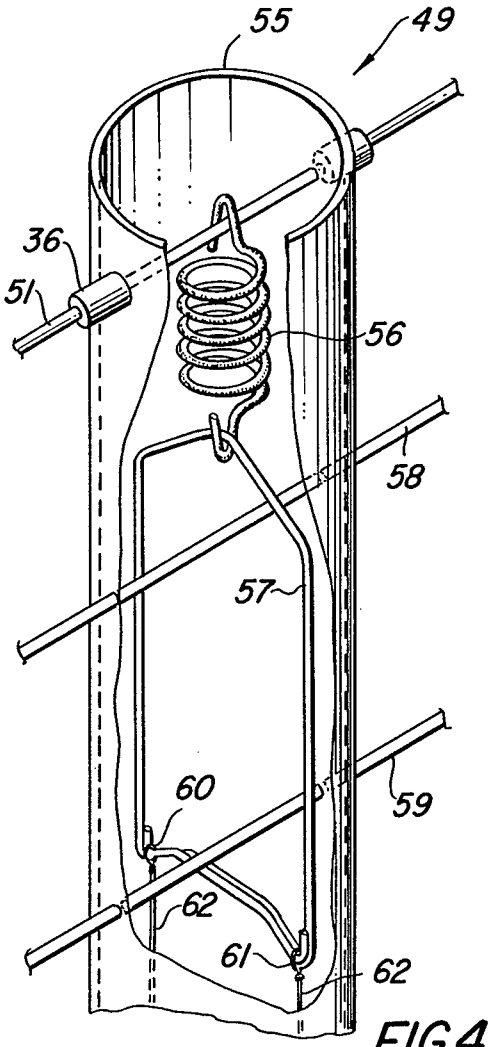
FIG. 4 is a perspective of an alternate embodiment of an intermediate post of the inventive fence having a portion broken away to show the interior.
Figure 3:
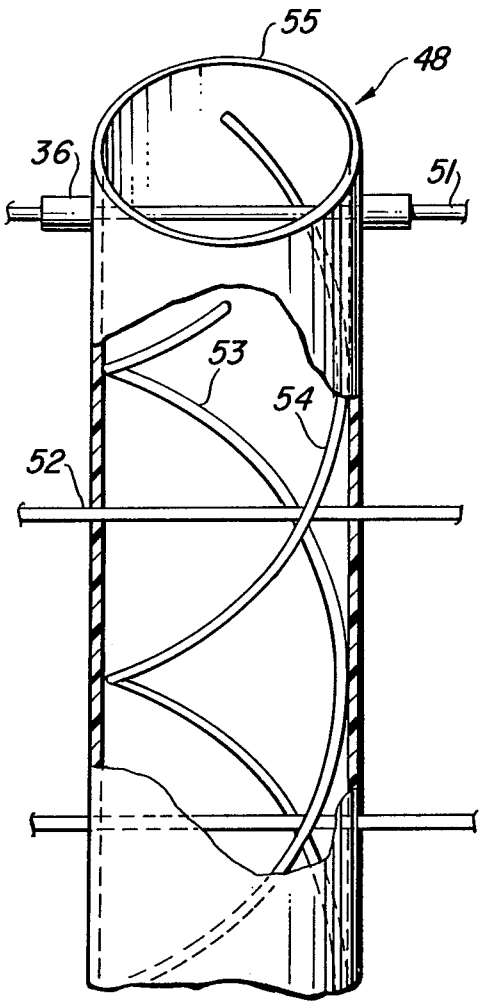
FIG. 3 is a perspective of an intermediate post of the inventive fence having a portion broken away to show the interior.

Thus, referring to FIGS. 3, 4, and 5 and to intermediate posts 48, 49, and 50 there is provided on the uppermost wire 51, on either side of the post, a swaged ferrule 36. Since the intermediate posts are formed of an electrically insulting material, separate insulators are not necessary for electrical isolation purposes, and by making the holes 52 in the intermediate posts of a small diameter, a tubular ferrule 36 firmly swaged to the wire, will not slide through the hole 52. Nevertheless, because the intermediate posts are formed of plastic, it is quite possible that an intruder would be tempted to saw through the posts to gain entry to the fenced area. For this reason, the present invention teaches an internal wiring system in each of the intermediate posts.

FIGS. 3, 4, and 5 are perspectives of three embodiments of an intermediate post of the fence of FIG. 1, each with portions thereof broken away for purposes of illustrating the internal workings of the posts. It should be understood that there are numerous constructions for this internal wiring system and only three such constructions are shown. These internal workings are designed so that the electronic sensor unit will detect any attempt to defeat the intermediate posts by cutting.

In the embodiment of FIG. 3, an intermediate post 48 is provided with two stainless-steel helical spring wires 53, 54 arranged inside a plastic pipe 55. The two wire helices 53, 54 are spaced so that only one wire of each coil passes between any two fence wires, when the fence wires are closely spaced, such as every two inches. Thus, the vertical spacing of the coils is such that the fence wires pass through the coil without touching or making electrical contact with the helical wires 53, 54. The wires 53, 54, are stretched and attached to the ends of the pipe 55. Since the helical wires 53, 54, are stretched so that they are under tension, if they are cut they will tend to move to their shorter unextended length. The at rest diameter of the unextended springs is chosen to hold them away from the fence wires if the post is bowed. If a spring wire is cut, it will spring back and make electrical contact with at least two of the horizontal fence wires bypassing at least two resistors in the resistor network and immediately be detected by the sensing unit, which will sound the alarm. The helical spring wires will stay in their proper position inside the post even when the post is bowed or bent and, therefore, the helical spring wires will not cause false alarms by the deflection of the post from its vertical axis.

In the embodiment of FIG. 4, plastic pipe 55 is used along with a tension spring 56 attached to and pulling the top fence wire 51. A yoke 57 pulls the spring 56 downwardly, straddles the next fence wire 58, and passes closely under the third fence wire 59. The spring 56 is chosen to have ample movement to pull the yoke 57 against the third fence wire 59. The bottom corners 60, 61 of the yoke 57 are pulled down by a polyester string 62, which passes over the corners 60 and 61 down each side of the plastic post 55, and is looped under the lowermost fence wire. In attempting to defeat this embodiment, at least one side of the string woud be cut, and the yoke will spring up and electrically connect the first and third fence wires, thereby bypassing two resistors, which will be immediately detected by the sensing unit, and which will actuate the alarms.

In the embodiment shown in FIG. 5, the intermediate post 50 is formed from the plastic extrusions 64, 65. PVC with an ultra-violet inhibitor is preferred. These extrusions lock together over the fence wires by means of male flanges 66, 67 cooperation with female flanges 68, 69. Slots or notches are formed in the male flanges 66, 67 68, 69 so that proper clearance is provided for the fence wires. It should be noted that in this embodiment it is not necessary to string the fence wires through holes in the plastic tube, rather, after the fence wires are up and stretched, the two halves of this embodiment are snapped together to form the intermediate post. Arranged inside of this post 50 is the spring 56 the yoke 57 and the string 62 of FIG. 4. The spring 56 is extended as in the embodiment of FIG. 4 and the operation is the same as was explained relation thereto.

Figure 6:
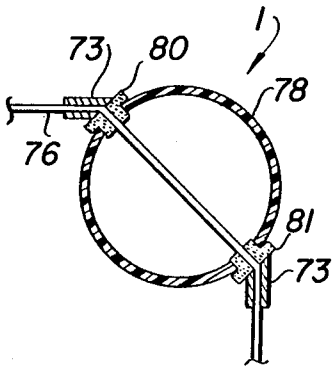
FIG. 6 is a top plan view in cross section of a corner post of the inventive fence.

FIG. 6 is a top plan view in cross section of a typical corner post 1 of FIG. 1. The manner in which the horizontal fence wires pass through and are secured to the corner post 1 and to posts 2 through 8 is identical, except for specialized 45° ferrules 73 at the corner post. The corner post 1 serves to provide the directional change necessary to circumscribe an enclosed area. In FIG. 6, a horizontal fence wire 76 enters the metal pipe 78 at substantially a 45° angle in relation to its original direction of travel and exits at a point diametrically opposed to its entry point, also at substantially a 45° angle in relation to its new direction of travel. In this manner, a right-angle (90°) turn is accomplished without the requirement of terminating the wires and starting a new fence zone in order to avoid a sharp bend in the wires. The corner posts 1 may comprise a four-inch diameter pipe 78, which is preferably formed of conventionally available, schedule 40, steel pipe. The fence wire 76 is maintained in electrical isolation from the pipe 78 by means of insulators 80, 81. These insulators 80, 81 are preferably formed of alumina but may also be formed of phenolic, plastic, or any other kind of high-dielectric, no-cold-flow material. The insulators 80, 81 are retained in place and the horizontal wire 76 firmly grasped by means of specialized ferrules 72, 73 which have one end cut at an angle of 45° and which are slid over the wire 76. The swaging of the ferrules 72, 73, provides a high-frictional contact with the wire. It may be seen from FIG. 6 that the horizontal wire 76 achieves a 90° change in direction without the requirement to bend the wire through an angle greater than 45°.

It is a feature of the present invention to provide a plurality of resistors electrically interconnecting the individual horizontal wires. The resistors are provided in order to present an easily detectable drop in resistance upon the contacting of any two fence wires, including any two adjacent fence wires.

Figure 7:
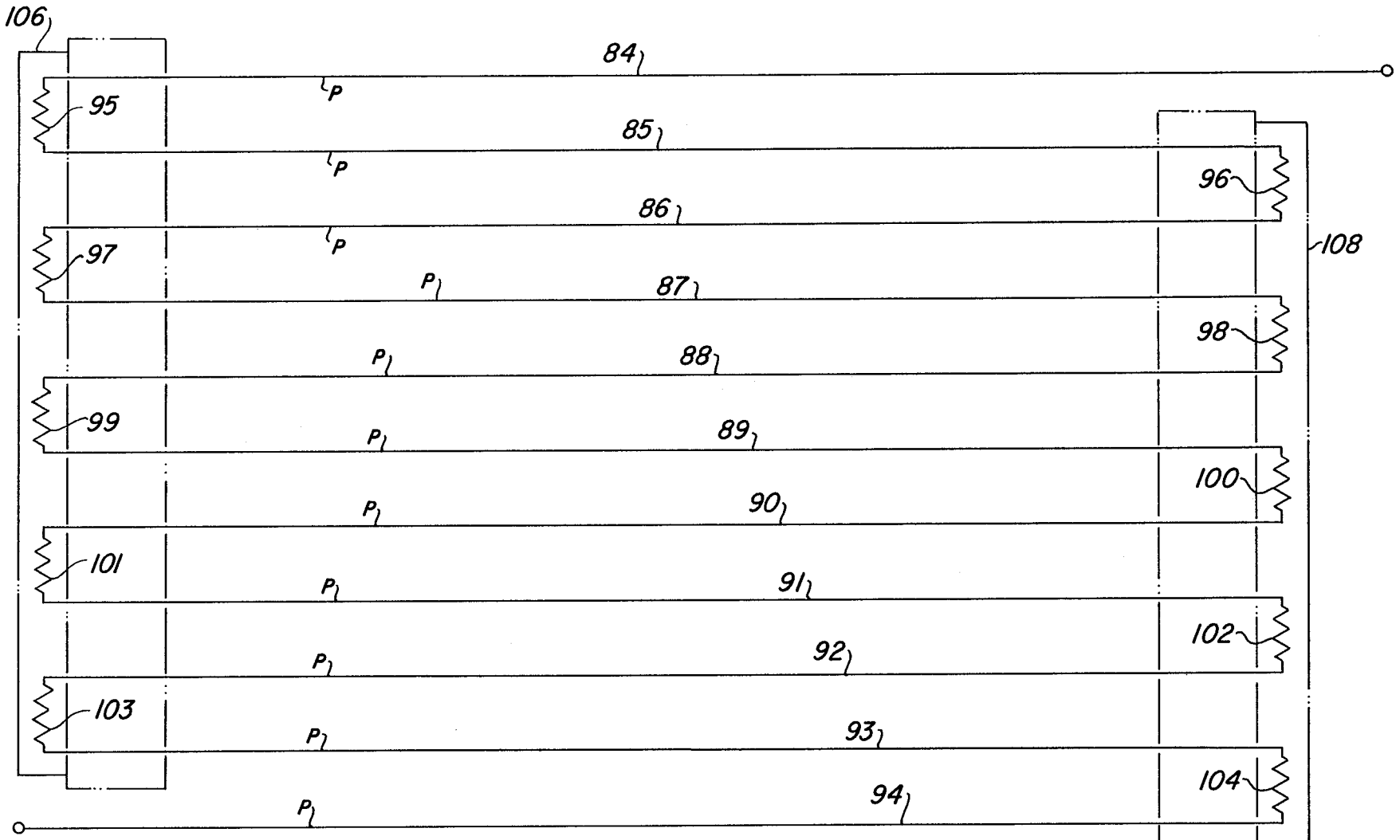

Referring then to FIG. 7, a typical wiring system is shown in abbreviated form consisting of only eleven horizontal fence wires, 84 through 94. Located between each of these horizontal wires are resistors. In this embodiment the resistor network should have value of 22,000 ohms minus 1010 ohms minus the total resistance of the fence wires, divided by the total number of fence wires minus one. This formula causes the voltage divider described below to present exactly plus three volts DC to the voltage comparators of the sensing circuit, when the fence is in its normal condition. Provisions in the sensing circuit are made for adjustments to allow some deviation from this value, so that the nearest standard value resistor can be chosen. Therefore, in this embodiment using eleven wires, the resistors, 95 through 104, each have a value of 2200 ohms. The resistors and wires are interconnected as shown in FIG. 7. Specifically, wires 84 and 85 are interconnected by resistor 95, similarly, wire pairs 86 and 87, 88 and 89, 90 and 91, 92 and 93 are interconnected by resistors 97, 99, 101, and 103, respectively. At the other end of the fence zone, wire pairs 85 and 86, 87 and 88, 89 and 90, 91 and 92, 93 and 94, are interconnected by resistors 96, 98, 100, 102 and 104, respectively. Thus, each horizontal wire is connected in series with the adjacent horizontal wire by a 2200 ohm resistor. Accordingly, touching two wires together will, at the very least, remove 2200 ohms from the total resistance of the fence, which will be more than enough to be detected by the inventive sensing system. The inventive sensing circuit is sufficiently sensitive so that the absence of one resistor can be sensed, even when the number of wires employed requires the use of 560 ohm resistors. Reliable electrical and mechanical connections between the resistors and the horizontal fence wires may be made by means of crimping, and the resistors can be located at any end, line, or corner post. The inventive fence can be readily sectioned off or zoned, and each zone of the fence can include a resistor network and can be electrically connected to a separate electronic sensing apparatus, so that an indication of an intrusion in a specific area can be provided.

The resistor networks are protected by hoods, or enclosures, attached to the posts. These enclosures are formed of plastic or metal channels and are shown at 106, 108 in FIGS. 7, 8, 9, and 10. The top resistor at one end of the network is seen at 95 in FIGS. 7, 8, 9, 10 and the top resistor at the other end of the network is seen at 96 in FIGS. 7, 8, and 10. If the fence is zoned, the appropriate portion of the resistor network must be located at both ends of each zone. Each zone will have its own separate wires, resistors, and sensing device.

The wires are terminated at each end of the fence, or at each end of the zone, and may be terminated at an end post as in FIG. 9, a corner post as in FIG. 8, or at a line post as in FIG. 10. If the fence is continuous, the wires will terminate at a corner post, as in FIG. 8, or a line post as in FIG. 10, but a continuous fence will, of course, have no end post. If a line post is used as a termination point, terminations and angling, as in FIG. 10, will be used to simplify the resistor enclosures, 106, 108. During installation, the wires are stretched between the termination points, which can be at the same post in single-zone installations. Ferrules 36 are employed to mechanically secure the wires along with insulators 34.

The electronic sensing apparatus of the present invention requires only one wire to be connected to the fence, provided that the fence and the sensing apparatus use an earth ground. Nevertheless, as earth ground is not always reliable, a separate ground wire may be employed. If the fence is zoned, and the separate ground wire is used, then only one common ground wire is required and, aside from this common ground wire, only one other wire is required to be connected to each zone. The top wire in the fence in the preferred embodiment has a potential of plus 3 volts DC applied thereto, with the bottom wire of the fence being at earth ground potential. Earth ground is specified since the sensing circuit employs its own internal ground separated from earth ground by a surge protection resistor. The sensing circuit operates generally by means of voltage comparators and, in the preferred embodiment, employs a single integrated circuit chip which has dual comparators formed thereon. Because of the resistors placed between each of the horizontal wires, and because of the design of the detection device, when any two fence wires touch each other, even adjacent wires, there will be an adequate voltage dropto actuate the under-voltage-sensing comparator. Similarly, adequate voltage drops will result when a person electrically bridges one or more of the horizontal wires in an attempt to cut out wires undetected.

The inventive sensing circuit operates so that if an abnormal current is sensed for even an extremely, short period, such as one-tenth of a second, the alarm will be triggered and can not be stopped unless a reset button is manually depressed at the monitoring station, assuming that the fence has been electrically returned to normal. In other words, should there be a momentary alteration in the current flow due to a trespasser, the inventive system will trigger the alarm and only the security personnel can extinguish and reset the alarm.

FIG. 11 is a circuit diagram of the inventive sensing apparatus. A typical fence segment is shown at 110, and the uppermost wire 112 thereof is connected by lead 114 to the sensing circuitry. The bottom wire 116 of the fence 110 is connected to the earth ground or zero potential. The typical fence segment 110 employs the resistor network connecting the horizontal wires in series, as shown in FIG. 7. Devices 118 through 121 and resistor 122 comprise commercially available means for the protection of the sensitive voltage sensing devices from surges caused by lightning. A push-to-test switch 124 is provided which opens the circuit of the fence connection line 114 and serves to simulate an alarm condition. In this fashion, the operation of the sensing system may be tested.

The power source in this embodiment is a 6 volt potential defference battery or DC power supply 126, not shown, and connected to the sensing circuit by leads 128 and 130. The positive voltage is on lead 128 and the ground, usually marked negative on batteries, is connected to chassis ground by lead 130 and to earth ground through a 10 ohm resistor 122, which is part of the device protection means. A filter capacitor 132, to protect all the sensing circuit from power supply fluctuations, is provided between the positive lead 128 and the chassis ground. The present embodiment of the sensing circuit uses a value of 22,000 ohms for resistor 134. Therefore, values of the resistors in the resistor network are chosen to yield, as close as practical, a resistance to earth ground of 22,000 ohms at 136 with switch 124 actuated.

Thus, provided there are no violations of the fence, i.e., no alarms, the combination of the 22,000 ohms fence wire and resistor network and the 22,000 ohm resistor 134 will result in a constant current flow through the fence to ground of 136 microamps, and there will be plus 3 volts DC to ground on line 138.

This embodiment of the inventive sensing circuit comprises two voltage comparators which are formed as a dual comparator chip denoted LM2903. The triggering levels of the two comparators, 140 and 142, are controlled by two fifteen turn, cermet potentiometers, 144 and 146, respectively. The potentiometers 144, 146 are chosen having a value of 20,000 ohms across the resistance path and are connected to the voltage source in parallel resulting in a 300 microamp current flowing through each potentiometer at all times. Due to the voltage divider network of resistor 134 and the devices to ground from 136 through the fence, plus 3 volts DC will be applied to the sensing circuit. Setting the two potentiometers 144, 146 at the mid-point will result in approximately plus 3 volts DC appearing on line 148 and on line 150. Line 148 is the positive reference level compared in voltage comparator 140, and line 150 is the negative reference level compared in voltage comparator 142. Ten megohm feedback resistors 152, 154 are provided from the output line 156 from the comparator 140 to the positive input 148 and from the output line 158 of comparators 142 to the positive input 150 of comparator 142 to prevent oscillation as recommended by the LM2903 manufacturer for this type of application. Line 160 serves as the signal input line to the two comparators and is connected to the fence through current limiting resistor 162 and line 138. Resistor 164 is a noise-rejection resistor, and capacitor 166 is a bypass capacitor. These parts protect the voltage comparator from power supply variations.

In order to provide the lower reference voltage necessary to detect a violation situation, potentiometer 146 is set so that the lower reference voltage on line 150 is slightly lower than the fence input voltage appearing at 160. If the wires of the fence 110 are electrically jumped in a vertical manner, or if any of the fence wires touch any other wires, so that one or more of the resistors in the fence are bypassed, the voltage appearing at line 160 from the fence will drop below the lower reference voltage at 150 and the output of 142 will go from normally open (as in a switch or relay) to ground via lead 162. When the comparator output goes to ground, it is customary to think of the comparator as turning on. Therefore, comparator 142 will turn on if the fence voltage drops.

With certain post spacing/wire spacing arrangements it will not be difficult to make adjacent wires touch, although it will still be very difficult for a wire to contact any wire other than its neighbor. To make such installations also virtually false-alarm free, the variable resistor 146 may be set at a value such that two fence resistors must be bypassed in order to cause the comparator 142 to turn on. In the case where it is difficult for adjacent wires to be brought together, the potentiometer 146 should be set so that the voltage on line 150 (which is below the voltage on line 160) is much closer to the voltage on line 160.

The upper reference voltage is set to about 3.3 volts by mens of variable resistor, 144. In the event that any fence wire is broken, then the voltage from the fence input on line 160 will immediately go to plus 6 volts DC. This voltage is over the upper reference level voltage set by variable resistor 144 and, therefore, comparator 140 will trigger and set its output to ground.

The above describes the manner in which comparators 140 and 142 operate to detect abnormalities occuring in the fence caused by an intruder. The following describes the manner in which the relay circuits of the inventive sensor operate by a fail-safe method and without the use of an energy-consuming latching relay or expensive electronics, so that upon detection the proper alarms will be energized and will remain energized until electrical integrity of the fence is restored and a reset switch is actuated.

When the comparators 140 and 142 are not actuated, i.e., when they are not triggered by an over voltage or an under voltage appearing on line 160, there will be a voltage of plus 6 volts coming through a 2200 ohm pull-up resistor 168 and through a 1,000 ohm current limiting resistor 170 to the base of a switching transistor 172, which will be switched on by plus voltage to its base and will be switched off if its base is grounded. A 2N2924 transistor is used in this embodiment. The emitter of transistor 172 is connected to system ground at 174, and the collector of transistor 172 is connected by line 175 to the coil 176 of a relay 178. Connected in parallel with the relay coil 176 is a diode 180, as is conventional. The proper operation of relay 180 requires that the parts within the area 182 be in close physical proximity. Relay 178 is energized when plus 6 volts DC is applied to its coil 176 through contacts 184, 186 from the power supply 126 through line 128. Therefore, absent any tampering with the fence, the relay 178 is pulled in and the contacts of relay 178 are normally as shown in FIG. 11. In other words, a circuit is made from the positive voltage line 128 to the ground connection 174 through the contacts 186 and 184, through the relay coil 176 and through the collector-emitter junction of the switched-on transistor 172.

Also, when relay 178 is pulled in, connection between line 192 and line 128 via line 188 and contacts 186 and 204, to energize the coil 194 of a second relay 196, is prevented. The other side of the relay coil 194 is connected to the system ground via line 198. Also connected in parallel to the relay coil 194 is another conventional diode 200. The contact set, shown generally at 202, is provided for connection to the alarm equipment. In this regard, the contacts 202 of relay 196 may be advantageously chosen to switch 110 volts, 10 amperes. In other words, no matter what type of alarm equipment is desired, a relay corresponding to 196 can be selected to handle it.

Assuming that a break in the fence occurs, or two fence wires are shorted together, this will change the voltage input to the comparators 140, 142 on line 160 and the output of one of the dual comparators 140, 142 will go to system ground by operation of the comparator. This will turn off transistor 172, thereby opening up the collector to emitter junction and breaking the current path from the voltage source through the coil 176 of the relay 178. When coil 176 is de-energized the contact swinger or arm 186 will move upwardly, and contact arm 186 will make contact with contact 204 of relay 178 which is connected to line 192, thus making the circuit from 188 and 128 and energizing relay coil 194. In this fashion then the six volts DC appearing on line 128 will be connected through line 188, relay contact swinger 186, and line 192 through the relay coil 194 and to system ground 198. The effect of operating the relay contacts, shown generally at 202, is to energize the appropriate alarm equipment.

In this embodiment, connected across the relay coil 194 is a lamp 204, which will be energized simultaneously with the relay coil 194. In this embodiment, the lamp 204 is actually the internal lamp in a reset switch 206. Therefore, upon an alarm condition being detected by the inventive sensor, the lamp 204, will cause the reset switch 206, to be illuminated.

Even if the integrity of the fence is now restored, current can not pass through coil 176 because the connection between 184 and 186 is open. Therefore, the connection between 186 and 204 can not be broken and the alarm and lamp will remain on. In order to reset the sensor and remove voltage from the relay coil 194 and the lamp 204, voltage must be supplied to coil 176 of relay 178 from another source. This is done by depressing the reset switch 206. This brings plus 6 volts from 188 and 128 to coil 176. Once coil 176 has been energized and relay 178 actuated, the circuit through contacts 184 and 186, coil 176, and transistor 172 is restored if the alarm situation no longer exists. Relay 178 will then remain actuated, coil 194 de-energized, and lamp 204 will remain off. This is an improved fail-safe method of maintaining an alarm condition after a momentary voltage change such as caused by a momentary electrical connection between any two wires.

The relay 196, the diode 200, the capacitor 132, the resistor 122, the power supply 126 and a common earth ground can be used with any number of duplicates of the remainder of the system. A fence can thus be protected by any number of separate violation detectors, any one of which can actuate relay 196 and keep it actuated until the fence is returned to normal and the separate detectors own reset switch is actuated. The security fence system can thus be zoned. A suitable map of the fence showing the various zones, can be utilized with the reset switch 206, and the violation lamp 204, located at the appropriate zone on the map, so that the section or zone which has been violated can be immediately detected by the monitoring personnel.

It is understood that the foregoing is presented by way of example only and is not intended to limit the scope of the present invention, except as set forth in the appended claims.

What is claimed is:

1. A security fence system, comprising:

a plurality of fence posts arranged around a selected area;

a plurality of high tensile strength, highly stressed wires arranged substantially horizontal to the ground and being attached to said fence posts in a mutually spaced-apart relationship;

a resistor network interconnecting said plurality of wires one to another and forming an electrical circuit such that making an electrical connection between any two wires will remove at least one resistor from said electrical circuit;

a voltage source connected to said circuit for causing a current of predetermined level to flow in said circuit; and a sensing means connected to said circuit for providing an indication of changes in said predetermined current level;

a plurality of intermediate nonmetallic posts, at least one of which is arranged between said fence posts, each of said plurality of wires passing through each of said intermediate nonmetallic posts and further comprising a metal assembly arranged internal to said nonmetallic post, such that cutting the intermediate nonmetallic post will cause said metal assembly to make an electrical circuit between at least two of each of said plurality of fence wires, thereby altering said predetermined current level in said circuit.

2. The security fence system of claim 1, wherein each of said high-tensile strength wires includes at least one annealed segment located between every two of said plurality of fence posts to which said wires are attached, said annealed segment having a lower tensile strength than the nonannealed portions of said wires.

3. The fence system of claim 2, wherein said fence wires have a diameter of 0.03 inches or less and a tensile stength greater than 50 pounds.

4. The fence system of claim 2, wherein said fence wires have a diameter of 0.036 inches or less and a tensile strength greater than 75 pounds.

5. The fence system of claim 1, further comprising ferrule means for affixing each of said plurality of wires to each of said plurality of fence posts, said ferrule means being arranged over said wires for being swaged thereupon to capture said wire.

6. The fence system of claim 1, further comprising electrical insulation means for electrically insulating said wires from said fence posts.

7. The fence system of claim 6, wherein said electrical insulation means comprise alumina insulators.

8. The fence system of claim 1, wherein said fence wires have a diameter of 0.03 inches or less.

9. The fence system of claim 8, wherein said fence wires have a tensile strength greater than 150 pounds.

10. The fence system of claim 1, wherein said fence wires have a diameter of 0.036 inches or less.

11. The fence system of claim 10, wherein said fence wires have a tensile strength greater than 225 pounds.

12. The fence system of claim 1, wherein said wires are mutually spaced apart by a distance between 1 and 5 inches.

13. The fence system of claim 1, wherein said wires are mutually spaced apart by a distance between 2 and 4 inches.

14. The fence system of claim 1, wherein said intermediate nonmetallic posts are formed of plastic pipe.

15. The fence system of claim 1, wherein said intermediate nonmetallic posts are formed of two extrusions which are assembled together over the fence wires.

16. The fence system of claim 1, wherein said metal assembly comprises two helical springs in uncoiled extension along the interior length of said intermediate nonmetallic post being attached to the ends of said post, and being arranged so that if one spring is cut, such spring will be displaced so as to come into electrical contact with at least two of said plurality of fence wires.

17. The fence system of claim 1, wherein said sensing means includes the second section of a voltage divider, the first section being said electrical circuit of said wires and said resistors, said voltage divider being connected to two voltage comparator means each having a predetermined reference voltage level, whereby when the current in said circuit through said voltage divider changes, and the voltage divider produces a voltage outside of said predetermined reference levels, one of said comparators will produce an altered output signal.

18. The fence system of claim 17, further including means connected to the output of said two comparator means and being operatively connected to an alarm signaling means for energizing said alarm signaling means upon said comparators detecting a change in the voltage input thereto.

19. A security fence system, comprising:

a plurality of fence posts arranged around a selected area;

a plurality of small diameter high tensile strength wires arranged substantially horizontal to the ground and being attached to said fence posts in a mutually spaced-apart manner;

each of said small diameter high tensile strength wires includes at least one annealed segment located between every two of said plurality of fence posts to which said wires are attached, said annealed segment having a lower tensile strength than the nonannealed portions of said wires.

* * * * *